US005095331A

United States Patent [19]

Takano

[11] Patent Number: 5,095,331

[45] Date of Patent: Mar. 10, 1992

[54] IMAGE FORMING APPARATUS HAVING TONER-EMPTY DETECTING AND INDICATING MECHANISM

[75] Inventor: Shouji Takano, Kawasaki, Japan

[73] Assignee: Kabushiki Kaisha Toshiba, Kawasaki, Japan

[21] Appl. No.: 426,593

[22] Filed: Oct. 25, 1989

[30] Foreign Application Priority Data

Oct. 31, 1988 [JP] Japan ..... 63-273055

[51] Int. Cl.[5] ..... G03G 21/00

[52] U.S. Cl. ..... 355/203; 355/206; 355/246

[58] Field of Search ..... 355/268, 246, 214, 203, 355/206, 264; 118/657, 658, 653

[56] References Cited

U.S. PATENT DOCUMENTS 4,032,227 6/1977 Hubbard et al. ..... 35/246 X
4,592,642 6/1986 Imaizumi et al. ..... 118/657 X
4,627,715 12/1986 Kikuno ..... 355/206
4,669,856 6/1987 Yamada ..... 355/246 X
4,742,372 5/1988 Takahashi ..... 355/246
4,745,440 5/1988 Kono et al. ..... 355/298 X
4,758,861 7/1988 Nakamaru et al. ..... 355/246 X
4,786,942 11/1988 Kusumoto et al. ..... 355/246 X
4,951,091 8/1990 Nawata ..... 355/206
4,977,429 12/1990 Tani et al. ..... 355/206 X
4,987,449 1/1991 Katoh ..... 355/206

FOREIGN PATENT DOCUMENTS 0072174 4/1983 Japan ..... 355/246

*Primary Examiner*—A. T. Grimley
*Assistant Examiner*—William J. Royer
*Attorney, Agent, or Firm*—Foley & Lardner

[57] ABSTRACT

The density of a toner in a developing device is detected by a magnetic sensor if the density is lower than a reference value, a toner-empty state is indicated on a control panel. When a copy key is operated in this toner-empty state, the number of copies in the toner-empty state is counted by means of a counter. If the count value is not larger than a preset value, the copying operation is allowed. If the count value exceeds the predetermined value, the copying operation is prohibited.

16 Claims, 7 Drawing Sheets

IMAGE FORMING APPARATUS HAVING TONER-EMPTY DETECTING AND INDICATING MECHANISM

BACKGROUND OF THE INVENTION

1. Field of the Invention

The present invention relates to an electronic copying machine having a developing device which uses a toner, for development, and more particularly, to a method for controlling the developing device in a toner-empty state.

2. Description of the Related Art

Electromagnetic copying machines are often provided with a developing device which develops an electrostatic latent image on a photoconductor by means of the magnetic brush method.

In order to keep the copy density of resulting images constant, in copying machines of this type, the density of the toner in the developing agent in the developing device is detected by means of a density sensor, and the detection signal is compared with a preset reference value. A toner supply unit is used to replenish the developing device with toner as required. By doing this, the toner density in the developing agent can be kept constant.

If the toner in the toner supply unit is reduced below a predetermined amount in copying machines constructed in this manner, a toner-empty state is indicated, and an instruction is given for toner supply.

In some conventional copying machines, the copying operation is prohibited when a toner-empty state is encountered. In others, the copying operation can be continued for repeated copying cycles even in the toner-empty state.

Immediately after a toner-empty state is encountered, the toner density in the developing agent is not too low, so that several cycles of normal copying operations can be executed. This cannot be done, however, according to the former control method in which the copying operation is prevented at the time when the toner-empty state is detected. In particular, if the toner-empty state is encountered in the course of continuous copying, the copying operation is interrupted despite the possibility of the several cycles of normal copying operation, which is a wholly situation.

Meanwhile, the copying operation can be unlimitedly performed according to the latter control method in which the operation is allowed to be continued even after the occurrence or on-set of a toner-empty state. Initially, therefore, several cycles of normal copying operations can be carried out. If the toner density falls drastically, however, images will be developed only by means of the carrier.

SUMMARY OF THE INVENTION

The object the present invention is to provide an image forming apparatus in which the image forming operation is permitted as much as possible despite the occurrence of a toner-empty state, and carrier developing of images can be prevented.

The above object of the present invention is achieved by an image forming apparatus comprising means for developing an original image on an image carrier to form an image thereon with a toner, means for detecting the density of the toner, means for counting the cycles of image forming operation when the toner density detected by the detecting means is lower than a predetermined value, and means for permitting the image forming operation before the count value in the counting means attains a predetermined value.

According to the present invention, the cycles of the image forming operation begin to be counted by the counter means immediately upon detection of a toner-empty state. The image forming operation is permitted up until the count value attains a predetermined value and, when the predetermined value is attained, further operation is prohibited. Even in the toner-empty state, therefore, the image forming operation is permitted as much as possible, and the toner density never falls drastically, so that carrier developing can be prevented.

DETAILED DESCRIPTION OF THE PREFERRED EMBODIMENTS

An embodiment of the present invention will now be described with reference to the accompanying drawings.

Figure 1:
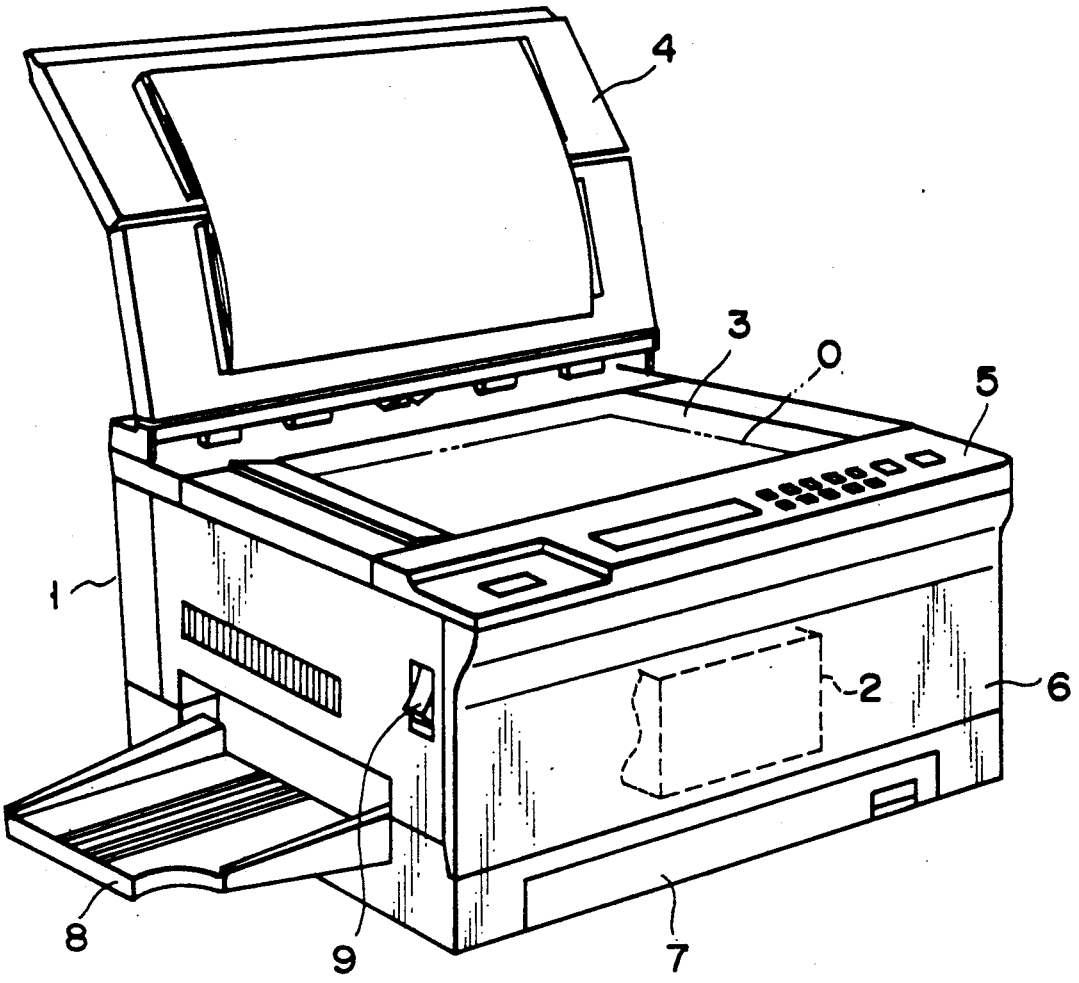
FIG. 1 is a perspective view showing an outline of an electronic copying machine.
Figure 2:
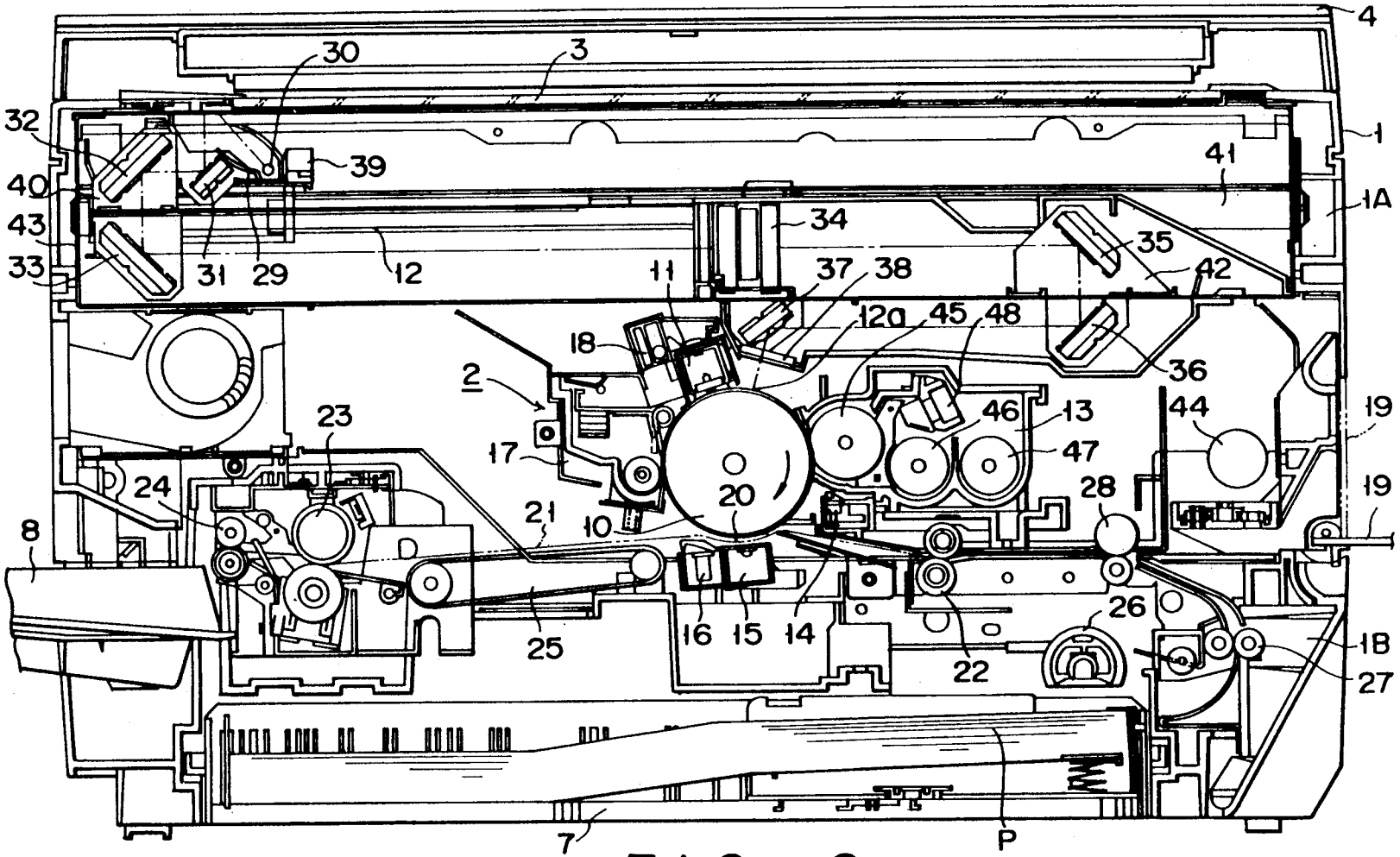
FIG. 2 is a sectional view showing the internal construction of the electronic copying machine.

FIGS. 1 and 2 show an electronic copying machine as an example of an image forming apparatus according to the present invention.

In FIG. 1, image forming unit 2 for performing image forming processes, including charging, exposure, development, transfer, separation, cleaning, deelectrification, fixation, etc., is disposed inside apparatus housing 1. Original table (transparent glass plate) 3 for setting original O is disposed on the top face of housing 1, and original cover 4 for holding down the original is swingably mounted on table 3. Control panel 5 is provided at the front edge portion of the top face of housing 1.

Swingable front cover 6 is attached to the front face of housing 1, and sheet cassette 7, which contains paper sheets (objects of transfer) P, such as ordinary paper, to be supplied to image forming unit 2, is removably attached to the lower front portion of the housing. Receiving tray 8 for receiving fixed sheets P, and power switch 9 are arranged on the left-hand side of housing 1.

In FIG. 2, image forming unit 2 is constructed as follows.

Photosensitive drum 10, for use as an image carrier, is disposed substantially in the center of the interior of housing 1. Drum 10 is surrounded by main charger 11, exposure unit 12*a* of exposure optical system 12, developing device 13, pretransfer discharge lamp 14, transfer charger 15, separation charger 16, cleaner (cleaning unit) 17, and discharge lamp 18, which are arranged successively in the rotating direction of the drum.

Disposed inside housing 1 is sheet transportation path 21, through which paper sheet P, automatically fed from sheet cassette 7 or manually supplied through sheet-bypass table 19, is guided to receiving tray 8 on the left-hand side of the housing, via image transfer section 20 between photosensitive drum 10 and transfer cassette 15. Paired aligning rollers 22 are arranged on the upper-course side of image transfer section 20, while fixing unit 23 and exit roller pair 24 is located on the lower-course side. Conveyor belt unit 25 is disposed between separation cassette 76 and fixing unit 23.

Located beside the mounting portion for sheet charge 7 are paper-supply roller 26, for fetching sheets P one by one, and separation/transportation unit 27, which includes a transportation roller and a separation roller. Unit 27 receives sheet P fetched by roller 26, and feeds it into a first branch transportation path or the upper-course portion of sheet transportation path 21. Sheet-bypass paired rollers 28 are located at the junction between the first branch transportation path and a second branch transportation path for manual feed. Exposure optical system 12 is composed of reflector 29, exposure lamp 30, first to fifth mirrors 31, 32, 33, 35 and 36, lens 34, and slit glass 38. Exposure lamp 30, which is backed by reflector 29, illuminates original O which is set on original table 3 on the top of housing 1. First, second, and third mirrors 31, 32 and 33 successively guide reflected light from original O to lens 34. Fourth, fifth, and sixth mirrors 35, 36 and 37 and slit glass 38 successively guide the transmitted light from lens 34 to photosensitive drum 10.

Exposure lamp 30, surrounded by reflector 29, and first mirror 31 are mounted on first carriage 39, which can reciprocate along the undersurface of original table 3. Second and third mirrors 32 and 33 are mounted on second carriage 40, which moves in the same direction as, and at half the speed of, first carriage 39. As carriages 39 and 40, guided by carriage shaft 41 or the like, move from the left to the right of FIG. 2, original O on table 3 is optically scanned so that photosensitive drum 10 is slit-exposed to an image corresponding to an original image. Fourth and fifth mirrors 35 and 36 are unified in mirror supporting member 42.

Constructed in this manner, exposure optical system 12 is integrally built in frame 43 for unification. Accordingly, it can be handled as a single structure.

Housing 1 is divided into two parts, upper and lower units 1A and 1B separated substantially by sheet transportation path 21. Upper unit IA can be swung up, as required, for about 25° around pivot 44 on the paper-supply side. Pivot 44 is formed of a shank portion of a torsion bar which continually urges upper unit 1A to swing open.

Photosensitive drum 10 rotates in the direction of the arrow of FIG. 2 so that its surface is first uniformly charged by main charger 11. As first and second carriages 39 and 40 move in the same direction with exposure lamp 30 on, on the other hand, original O on original table 3 is exposed for scanning. The image of original O is focused on drum 10 by means of exposure optica system 12, so that an electrostatic latent image is formed on the drum.

The electrostatic latent image, thus formed on the surface of photosensitive drum 10, is opposed to developing device 13 to be developed thereby into a toner image. Thereafter, the toner image is delivered to image transfer section 20, which faces transfer charger 15, and is transferred to the surface of paper sheet P fed from paired aligning rollers 22. Sheet P, having the toner image thereon, is separated from the surface of drum 10 by separation charger 16, and is guided through conveyor belt unit 25 to fixing unit 23. After the toner image is fixed by means of unit 23, sheet P is discharged onto receiving tray 8 by paired exit rollers 24.

After the toner image is transferred to sheet P, photosensitive drum 10 is opposed to cleaner 17, and the drum surface is cleared of residual toner particles by means of the cleaner. Thereafter, residual electric charge on drum 10 is removed by means of discharge lamp 18, whereupon the drum is ready for the next copying operation.

Developing device 13 develops the electrostatic latent image by using a two-component developing agent composed of a toner and a carrier. Device 13 comprises magnetic roller (developing roller) 45, stirring feeder 46, developing agent stirrer 47, and magnetic sensor 48 for use as toner density detecting means.

Magnetic roller 45 forms a magnetic brush of the developing agent on its surface, thereby transporting the developing agent to a sliding-contact portion between roller 45 and photosensitive drum 10. Stirring feeder 46 stirs and feeds the toner supplied from a toner supply unit or toner hopper (not shown). Developing agent stirrer 47 stirs the developing agent. Magnetic sensor 48 detects the density of the toner in the developing agent by detecting the magnetic resistance of the developing agent, which varies depending on the mixture ratio between the toner and the carrier, and delivers an analog voltage signal equivalent to the toner density. Sensor 48 will be described in detail later.

The toner hopper containing the toner for replenishment is provided on one end of developing device 13. As a toner supply roller at the bottom of the toner hopper is rotated by means of a toner supply motor, the toner in the hopper is resupplied to device 13. Neither the toner hopper, the toner supply roller, and the toner supply motor are shown.

Figure 3:
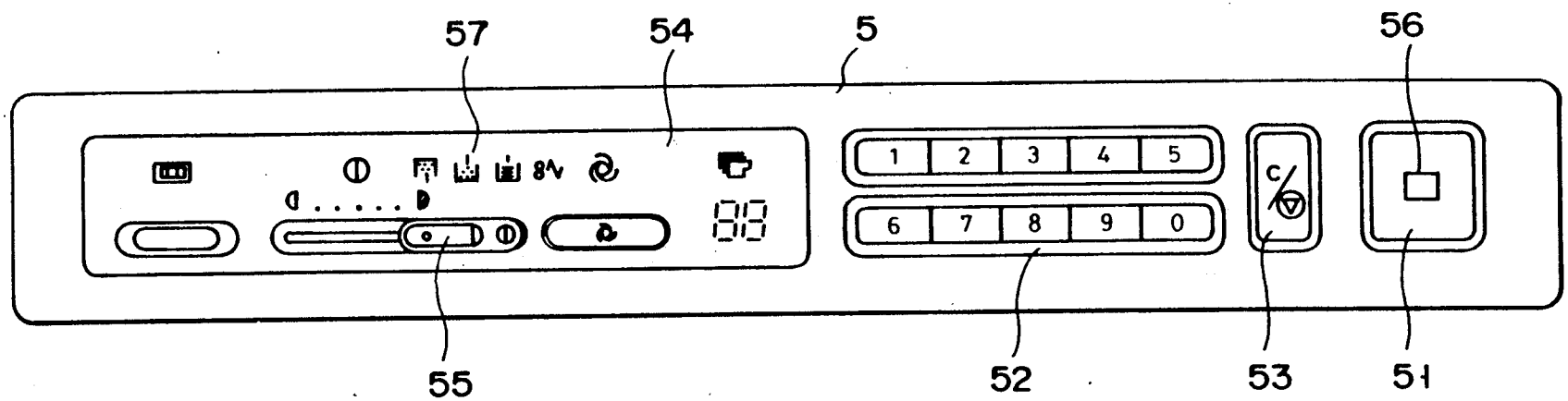
FIG. 3 is a plan view showing the arrangement of a control panel.

FIG. 3 shows control panel 5.

Control panel 5 comprises copy key 51 for starting the copying operation, numerical pad 52 for setting the number of copies, clear/stop key 53 for clearing the set number of copies or stopping the copying operation, liquid-crystal display section 54 for displaying the operating states of various units or sections or the number of copies, and exposure value setter 55 for setting the exposure value. Copy key 56 is provided with indicator 56 which indicates the readiness for the copying operation by color lighting. Display section 54 is provided with toner-empty display 57 and the like. Display 57 is lit to request a toner resupply when the toner in the hopper is insufficient.

Figure 4:
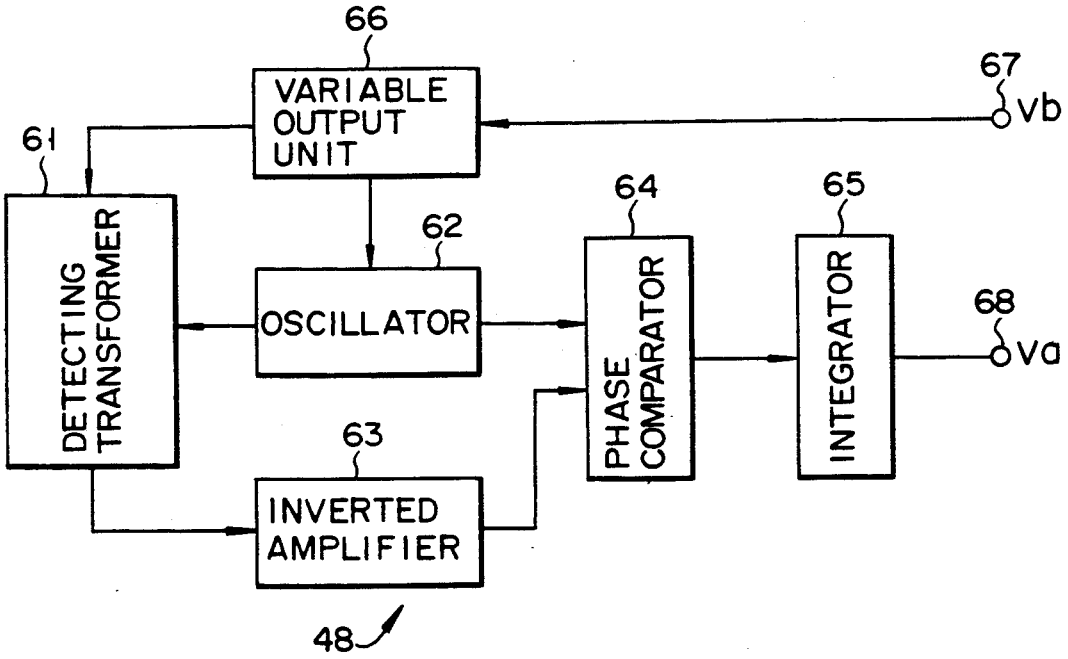
FIG. 4 is a block diagram schematically showing the arrangement of a magnetic sensor.

FIG. 4 schematically shows an arrangement of magnetic sensor 48. Sensor 48 is composed of detecting transformer 61, oscillator 62, inverted amplifier 63, phase comparator 64, integrator 65, and variable output unit 66.

Control voltage input terminal 67 is connected to the input end of variable output unit 66, whose output end is connected to a secondary coil (not shown) of detecting transformer 61 and oscillator 62. Oscillator 62 is connected to a primary coil (not shown) of transformer 61 and one input end of phase comparator 64. Inverted amplifier 63 is connected to both the secondary coil of transformer 61 and the other input of comparator 64. The output end of phase comparator 64 is connected to the input end of integrator 65, whose output end is connected to output terminal 68.

When power is applied, in this arrangement, oscillator 62 starts high-frequency oscillation, whereupon a voltage is produced in the primary coil of detecting transformer 61. As a result, an induced electromotive force, inversely proportional to the toner density in the developing agent, is produced in the secondary coil of transformer 61. Variable output unit 66 produces a voltage corresponding to analog control voltage Vb externally input through control voltage input terminal 67. The produced voltage is added to the electromotive force in the secondary coil of transformer 61, and supplied to inverted amplifier 63. Amplifier 63 inverts the supplied voltage, and delivers a waveformshaped output. The output of amplifier 63 is compared for phase with the voltage produced in the primary coil of detecting transformer 61 by means of phase comparator 64. The output of comparator 64 is integrated by means of integrator 65, and is delivered as output voltage Va to output terminal 68.

Figure 5:
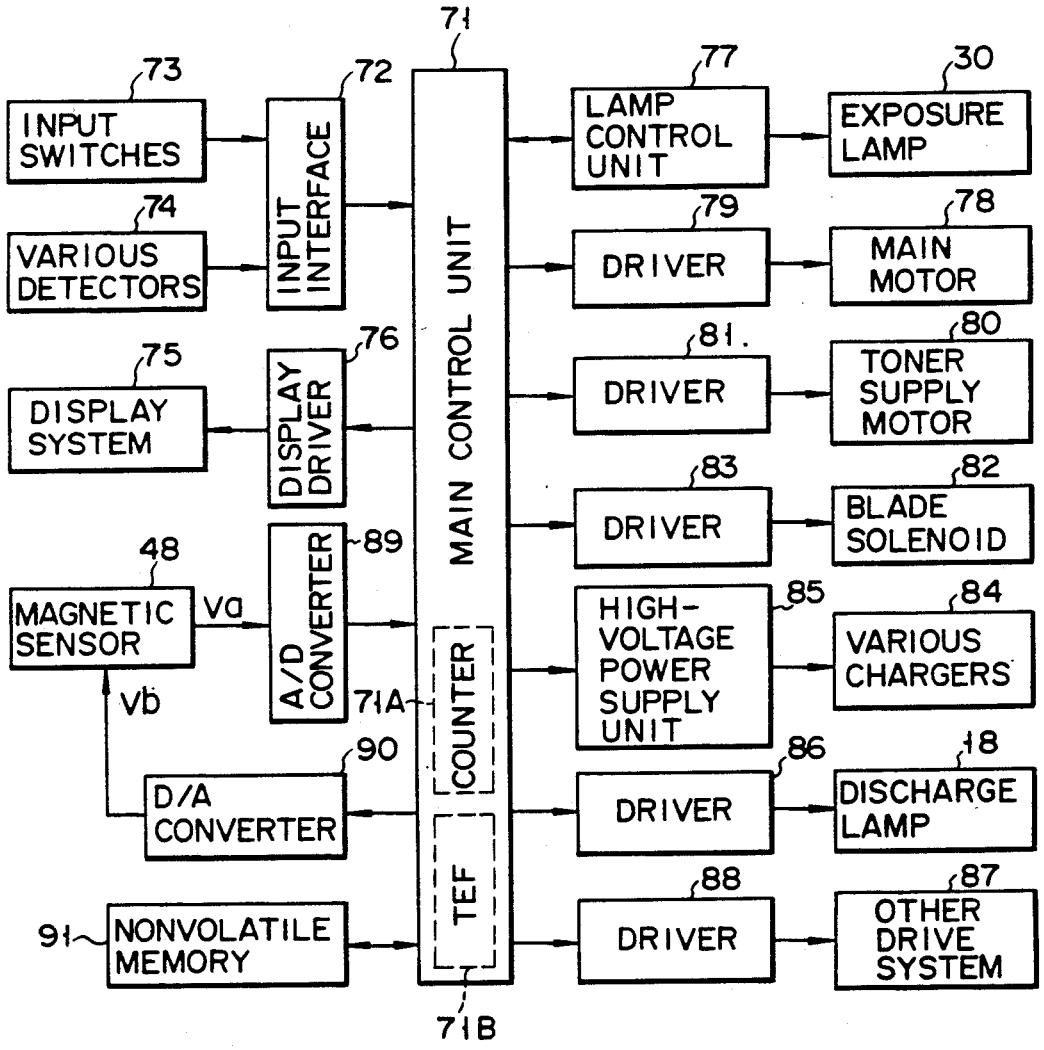
FIG. 5 is a block diagram showing the arrangement of a control system.

FIG. 5 shows a general control system.

Main control unit 71, which serves to control the whole apparatus, is formed of, e.g., a microcomputer. It includes counter 71A for counting the number of copies after a toner-empty state (mentioned later) is entailed and toner-empty flag (TEF) 71B adapted to be set when the toner empty state is entailed.

Main control unit 71 is connected, through input interface 72 such as a data selector, with input switches 73, e.g., the various keys on control panel 5, and various detectors 74 including switches and sensors required for other control.

Also, main control unit 71 is connected with display driver 76 for driving display system 75, including display section 54 on control panel 5 and various other display devices, and lamp control unit 77 for controlling exposure lamp 30.

Further, main control unit 71 is connected with driver 79 for driving main motor 78, driver 81 for driving toner supply motor 80, which is used to drive the toner supply roller (not shown), and driver 83 for driving blade solenoid 82, which is used to drive a blade of cleaner 17. Furthermore, unit 71 is connected with high-voltage power supply unit 85 for driving various chargers 84, including chargers 11, 15 and 16, driver 86 for driving discharge lamp 18, and driver 88 for driving drive system 87, which includes other motors, clutches, and solenoids.

Main control unit 71 is further connected with A/D converter 89 and D/A converter 90, which are connected with magnetic sensor 48. Output voltage Va of sensor 48 is applied to the input of A/D converter 89. Converter 89 converts voltage Va into digital data, and supplies it to unit 71. Also, unit 71 supplies D/A converter 90 with adjustment data which is used to adjust output voltage Va of sensor 48 to a reference voltage corresponding to a reference toner density. Converter 90 converts the supplied data into contro voltage Vb as an analog voltage, and supplies it to magnetic sensor 48.

Furthermore, main control unit 71 is connected with nonvolatile memory 91, which stores the adjustment data and the like.

Figure 6:
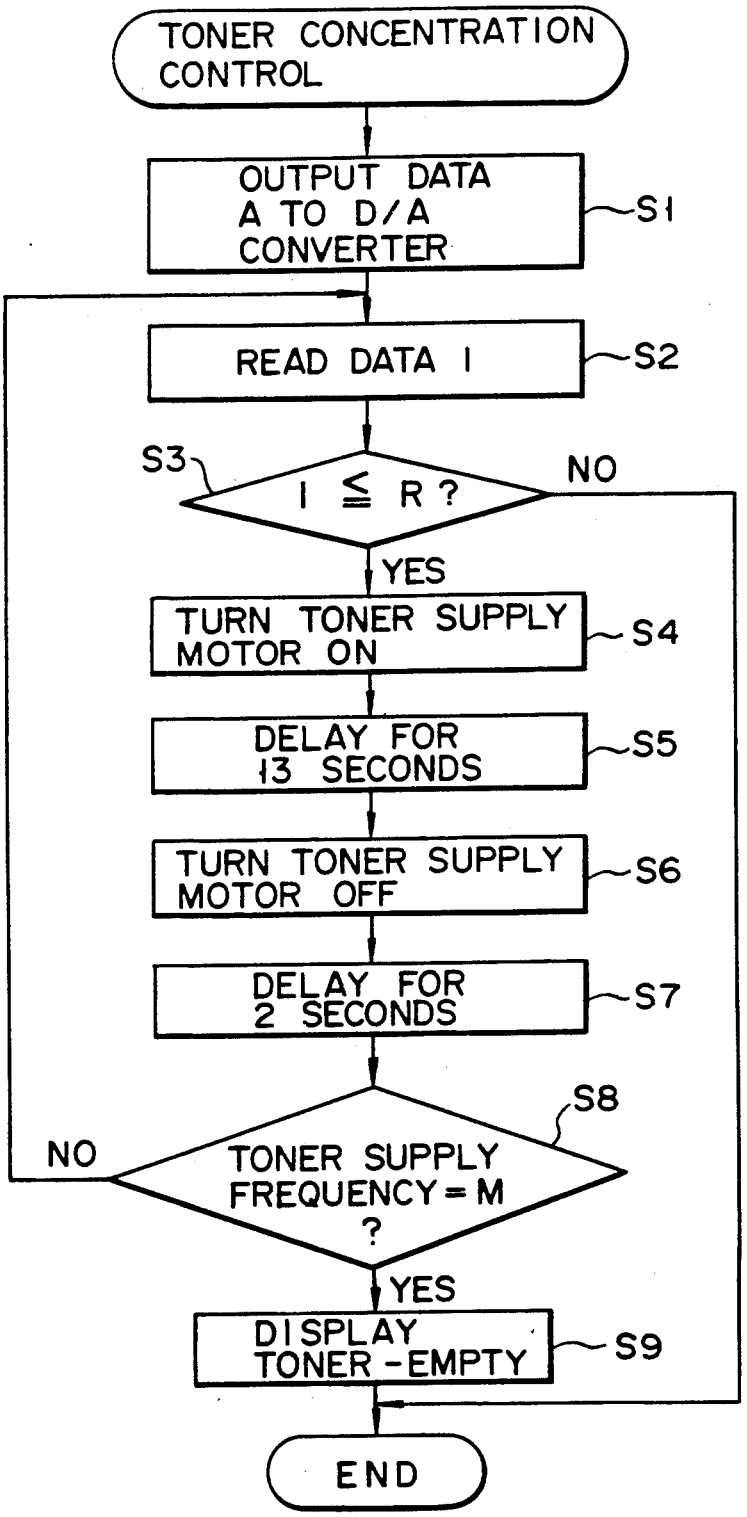
FIG. 6 is a flow chart for illustrating the toner density control operation.

Referring now to FIG. 6, control operation for the toner density will be described. This operation is executed interrupting the operation of main control unit 71.

First, adjustment data A stored in nonvolatile memory 91 is read out and delivered to D/A converter 90 (Step S1). Converter 90 converts input adjustment data A into corresponding control voltage Vb, and supplies it to control voltage input terminal 67 of magnetic sensor 48. In response to the input control voltage Vb, sensor 48 is automatically adjusted to a voltage corresponding to the reference toner density.

Subsequently, toner density data delivered from A/D converter 89 is read as input data I (Step S2), and data I is compared with reference density data R previously stored in nonvolatile memory 91 (Step S3). If $I \leqq R$ is not fulfilled, that is, if the detected toner density is high enough, the control of the toner density is finished.

If $I \leqq R$ is fulfilled in Step S3, that is, if the detected toner density is equal to or lower than the reference density, toner supply motor 80 is driven to cause the toner to be resupplied to developing device 13 (Step S4). Motor 80 is driven in a 1.5-second-on, 1.2-second-off cycle, for example. Thus, after a delay of e.g. 13 seconds (Step S5), motor 80 is switched off (Step S6). Then, after a delay of e.g. 2 seconds (Step S7), whether the toner has been resupplied M times (e.g., 13 times) is determined (Step S8). If it is found that the toner has not been resupplied M times, the program returns to Step S2, whereupon the aforementioned processes of operation are repeated.

If it is found in Step S8 that the toner has been resupplied M times, then the toner density cannot exceed a predetermined value despite the toner supply. Thus, it is concluded that the amount of toner in the toner hopper is less than a predetermined amount, whereupon toner-empty display 57 at display section 54 of control panel 5 is turned on, and toner-empty flag (TEF) 71B is set (Step S9). Thereupon, the toner density control is finished.

Figure 7:
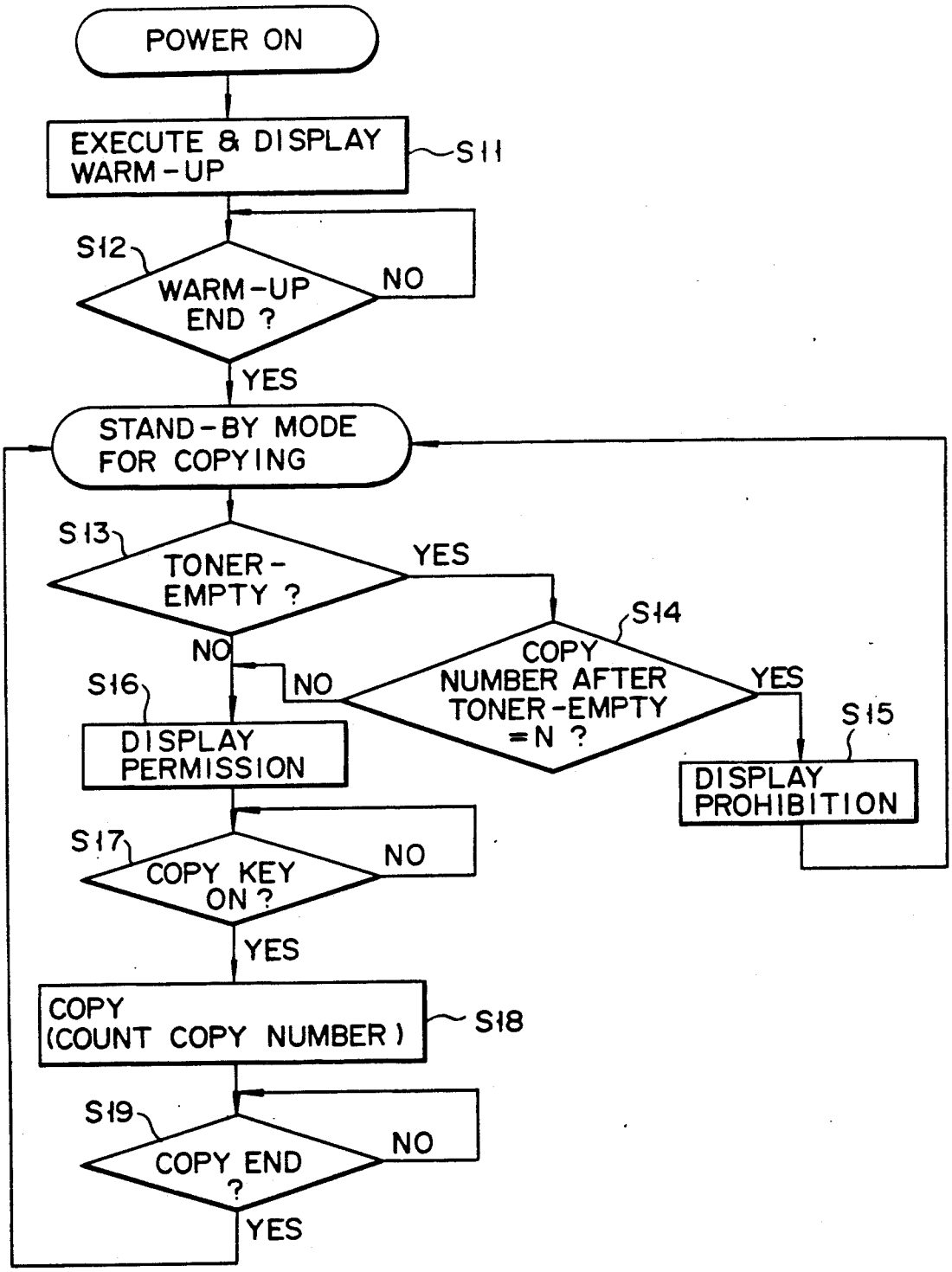
FIG. 7 is a flow chart for illustrating the general operation.

Referring now to FIG. 7, the operation will be described.

When power switch 9 is turned on, main control unit 71 starts its warm-up operation, and indicates it by lighting indicator 56 on control panel 5 in red color (Step S11). When the warm-up operation ends, the warm-up indication is stopped, whereupon a stand-by mode for copying is established (Step S12).

In the stand-by mode, whether the toner-empty state has been reached is determined with reference to toner-empty flag (TEF) 71B (Step S13). If the toner-empty state is detected, therefore, whether preset value N is attained by the number of copies counted by counter 71A, after the toner-empty state occurs, is determined (Step S14). If predetermined value N is attained by the count value of counter 71A, indicator 56 of control panel 5 glows with a red light, thereby indicating the cessation of copying (Step S15), and the stand-by mode for copying is restored.

If the toner-empty state is not detected in Step S13, or if it is concluded that predetermined value N is not attained by the count value of counter 71A on the other hand, indicator 56 of control panel 5 glows with a green light, thereby indicating permission to copy (Step S16).

Thereafter, whether copy key 51 is turned on is determined (Step S17). If it is concluded that key 51 is on, the copying operation is performed in accordance with the aforementioned copying process (Step S18). If toner-empty flag (TEF) 71B is set at this time, the number of copies is counted by counter 71A. If it is concluded that the copying operation is finished (Step S19), the stand-by mode for copying is restored again.

Thus, the number of copies is counted by means of counter 71A after the toner-empty state is detected, and the copying operation is permitted until the count value attains predetermined value N. When value N is attained, the copying operation is stopped. Even if the toner-empty state is entailed, therefore, the copying operation is permitted as much as possible, and the toner density never falls drastically, so that carrier developing can be avoided.

Although the electronic copying machine has been described as an example of the image forming apparatus in the aforementioned embodiment, the present invention is not limited to that embodiment, and may be also applied to any other image forming apparatus, such as a laser printer or electronic printer, having a developing device which uses a two-component developing agent, formed of a toner and a carrier.

What is claimed is:

1. An image forming apparatus comprising:

means for developing an original image on an image carrier to form an image thereon with a toner;

means for detecting the density of the toner;

means for displaying a toner-empty status when the toner density detected by the detecting means is lower than a predetermined value;

means for counting the cycles of image forming operation when the toner-empty status is displayed by the displaying means; and means for performing the image forming operation before the count value in the counting means attains a predetermined value.

2. An apparatus according to claim 1, wherein the developing means contains a developing agent having a toner and a carrier.

3. An apparatus according to claim 1, further comprising means for supplying the toner to the developing means.

4. An apparatus according to claim 3, further comprising means for driving the supply means in response to the result of the detection by the detecting means.

5. An apparatus according to claim 4, further comprising means for identifying a toner-empty state when the toner density detected by the detecting means is lower than the predetermined value after the drive means is driven a preset number of times.

6. An apparatus according to claim 5, wherein said detecting means includes a magnetic sensor.

7. An apparatus according to claim 8, wherein said magnetic sensor includes means for generating a high-frequency signal, transformer means supplied with the high-frequency signal produced by the generating means, means for supplying a reference signal to the transformer means, means for comparing the phase of an electromotive force corresponding to the toner density, delivered from the transformer means, with that of the high-frequency signal, and means for integrating the output of the comparing means.

8. An apparatus for determining the density of a toner comprising:

means for supplying the toner to the developing means;

means for detecting the density of the toner;

means for driving the supplying means in response to the result of the detection by the detecting means;

means for identifying a toner-empty status when the toner density detected by the detecting means is lower than a predetermined value after the drive means is driven a preset number of times; and means for displaying information showing the toner-empty status identified by the identifying means.

9. An apparatus according to claim 8, wherein the developing means contains a developing agent having a toner and a carrier.

10. An apparatus according to claim 8, wherein said detecting means includes a magnetic sensor.

11. An apparatus according to claim 10, wherein said magnetic sensor includes means for generating a high-frequency signal, transformer means supplied with the high-frequency signal produced by the generating means, means for supplying a reference signal to the transformer means, means for comparing the phase of an electromotive force corresponding to the toner density, delivered from the transformer means, with that of the high-frequency signal, and means for integrating the output of the comparing means.

12. An apparatus according to claim 8, further comprising means for indicating information of the toner-empty state if the toner-empty state is identified by the identifying means.

13. An apparatus according to claim 8, further comprising means for setting a flag indicative of the toner-empty state if the toner-empty state is identified by the identifying means.

14. An image forming method comprising: detecting the density of a toner;

displaying a toner-empty status when the detected toner density is lower than a predetermined value;

counting the cycles of image forming operation when the toner-empty status is displayed; and performing the image forming operation before the count value attains a predetermined value.

15. A magnetic sensor for detecting the density of toner in an image forming apparatus, comprising:

means for generating a high-frequency signal;

transformer means for receiving the high-frequency signal produced by the generating means;

means for supplying a reference signal to the transformer means;

means for comparing the phase of an electromotive force corresponding to the toner density, delivered from the transformer means, with the phase of the high-frequency signal; and means for integrating the output of the comparing means, the integrated output indicating if a toner-empty state has been reached.

16. The magnetic sensor of claim 15 further including means for driving the image forming apparatus a preset number of times following the indication of the toner-empty state.

* * * * *